US012478820B2

(12) United States Patent
Lee et al.

(10) Patent No.: US 12,478,820 B2
(45) Date of Patent: Nov. 25, 2025

(54) FITNESS DEVICE

(71) Applicant: INVENTEC APPLIANCES CORPORATION, New Taipei (TW)

(72) Inventors: Che-Wei Lee, New Taipei (TW); Chih-Hsuan Hsiao, New Taipei (TW)

(73) Assignee: INVENTEC APPLIANCES CORPORATION, New Taipei (TW)

( * ) Notice: Subject to any disclaimer, the term of this patent is extended or adjusted under 35 U.S.C. 154(b) by 129 days.

(21) Appl. No.: 18/629,902

(22) Filed: Apr. 8, 2024

(65) Prior Publication Data

US 2025/0195934 A1 Jun. 19, 2025

(30) Foreign Application Priority Data

Dec. 13, 2023 (TW) ..... 112148417

(51) Int. Cl.

| | |
|---|---|
| ***A63B 21/005*** | (2006.01) |
| ***A63B 21/00*** | (2006.01) |
| ***A63B 24/00*** | (2006.01) |
| ***A63B 71/06*** | (2006.01) |

(52) U.S. Cl.

CPC ..... *A63B 21/0058* (2013.01); *A63B 21/4045* (2015.10); *A63B 21/4047* (2015.10); *A63B 24/0087* (2013.01); *A63B 71/0622* (2013.01)

(58) Field of Classification Search

CPC ..... A63B 21/0058; A63B 21/4045; A63B 21/4047; A63B 24/0087; A63B 71/0622; A63B 21/4035; A63B 23/03525; A63B 21/0726; A63B 23/04; A63B 69/06

See application file for complete search history.

(56) References Cited

U.S. PATENT DOCUMENTS

| | | | | | |
|---|---|---|---|---|---|
| 3,511,225 | A * | 5/1970 | Gunpei | A63B 69/408 | 124/36 |
| 3,953,025 | A * | 4/1976 | Mazman | A63B 23/0355 | 482/118 |
| 5,104,121 | A * | 4/1992 | Webb | A63B 23/0233 | 482/137 |
| 5,277,684 | A * | 1/1994 | Harris | A63B 23/03533 | 482/121 |

(Continued)

FOREIGN PATENT DOCUMENTS

| | | | |
|---|---|---|---|
| CN | 111760250 | A | 10/2020 |
| TW | I730875 | B | 6/2021 |
| WO | WO2020171830 | A1 | 8/2020 |

*Primary Examiner* — Garrett K Atkinson

(74) *Attorney, Agent, or Firm* — Li & Cai Intellectual Property Office

(57) ABSTRACT

A fitness device including an exercise assembly is provided. The exercise assembly includes a first rotary motor and a linear motor. A user applies an exerted force to operate the exercise assembly according to different movement trajectories of multiple training movements, such that the exercise assembly is driven by the linear motor to move linearly along an axis, and is driven by the first rotary motor to rotate. The first rotary motor outputs a rotational resistive force in response to the rotation of the exercise assembly, the linear motor outputs a linear resistive force in response to the movement of the exercise assembly, and the rotational resistive force and the linear resistive force are combined to form an integrated resistive force. The exerted force is greater than the integrated resistive force.

10 Claims, 10 Drawing Sheets

(56) References Cited

U.S. PATENT DOCUMENTS

| | | | | |
|---|---|---|---|---|
| 5,897,444 | A * | 4/1999 | Hellyer | A63B 69/0075 473/417 |
| 6,508,748 | B1 * | 1/2003 | Ish, III | A63B 21/078 482/9 |
| 7,985,166 | B2 * | 7/2011 | Farnsworth | A63B 23/1209 482/54 |
| 10,258,821 | B2 * | 4/2019 | Jeong | A63B 23/03575 |
| 11,097,148 | B2 * | 8/2021 | Kennington | A63B 21/169 |
| 2003/0017918 | A1 * | 1/2003 | Webb | A63B 21/156 482/99 |
| 2007/0161470 | A1 * | 7/2007 | Berryman | A63B 69/3629 482/100 |
| 2009/0111666 | A1 * | 4/2009 | Wang | A63B 22/0235 482/54 |
| 2010/0069798 | A1 * | 3/2010 | Cheng | A61H 1/0262 602/5 |
| 2015/0335950 | A1 * | 11/2015 | Eder | A63B 22/0605 482/8 |
| 2017/0239517 | A1 * | 8/2017 | Jeong | A63B 22/04 |
| 2017/0266481 | A1 * | 9/2017 | Dalebout | A63B 21/0552 |
| 2017/0319905 | A1 * | 11/2017 | O'Connor | A63B 21/00181 |
| 2022/0054344 | A1 * | 2/2022 | Hsu | A61H 1/0288 |
| 2022/0296963 | A1 * | 9/2022 | Belson | A63B 71/0054 |

* cited by examiner

FITNESS DEVICE

CROSS-REFERENCE TO RELATED PATENT APPLICATION

This application claims the benefit of priority to Taiwan Patent Application No. 112148417, filed on Dec. 13, 2023. The entire content of the above identified application is incorporated herein by reference.

FIELD OF THE DISCLOSURE

The present disclosure relates to a fitness device, and more particularly to a fitness device suitable for various exercises and improving usage safety.

BACKGROUND OF THE DISCLOSURE

Generally, a fitness device is only suitable for training a single muscle group, and users need to operate various fitness devices to train more muscle groups. However, having many fitness devices can occupy too much of limited indoor space, and can be expensive for those who exercise at home. In addition, traditional fitness devices generally provide the user with resistive force through the weight of bar plates, such as to allow the user to apply force against the weight of the bar plates to achieve muscle-training effects. However, traditional fitness equipment can easily cause sports injuries when the user's physical strength is insufficient to bear the weight in use for training.

SUMMARY OF THE DISCLOSURE

In order to solve the above-mentioned problems, one of the technical aspects adopted by the present disclosure is to provide a fitness device, which includes an exercise assembly. The exercise assembly includes a first rotary motor and a linear motor. A user applies an exerted force to operate the exercise assembly according to various movement trajectories of multiple training movements, such that the exercise assembly is driven by the linear motor to move linearly along an axis, and is driven by the first rotary motor to rotate. The first rotary motor outputs a rotational resistive force in response to the rotation of the exercise assembly, the linear motor outputs a linear resistive force in response to the movement of the exercise assembly, and the rotational resistive force and the linear resistive force are combined to form an integrated resistive force. The exerted force is greater than the integrated resistive force.

Therefore, in the fitness device provided by the present disclosure, the first rotary motor and the linear motor respectively output rotational resistive force and linear resistive force in response to the rotation and movement of the exercise assembly, such as to allow the user to achieve training effects. Furthermore, the fitness device provided by the present disclosure can provide tolerable resistive force to the user and enable the user to perform targeted exercises of specific muscle groups with correct exercise postures to achieve good exercise efficiency and effect.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
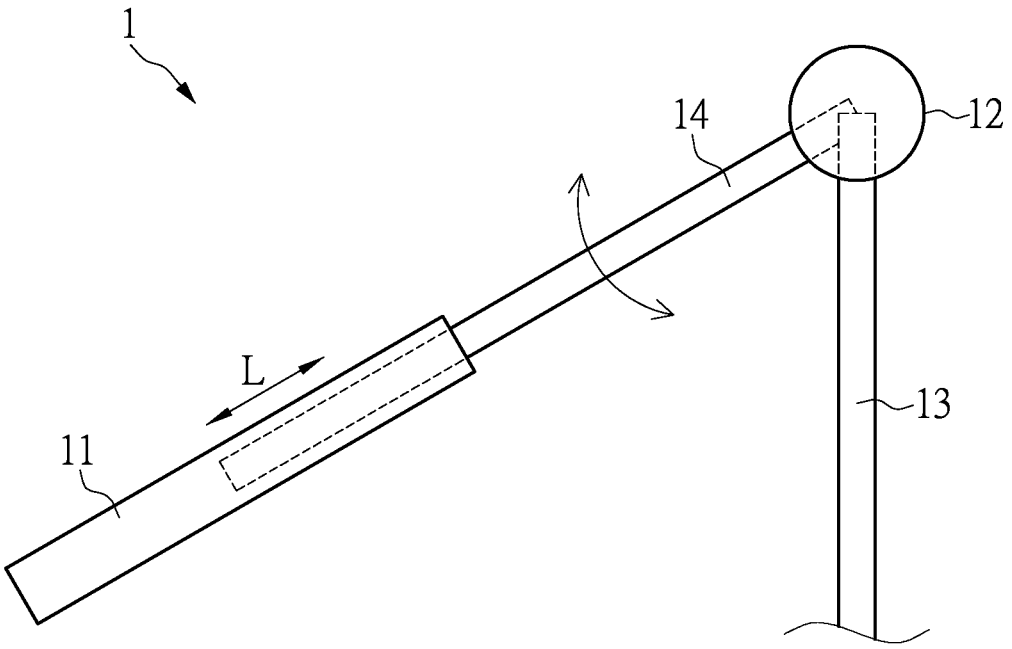
FIG. 1 is a schematic view of an exercise assembly according to an embodiment of the present disclosure.

Referring to FIG. 1, FIG. 1 is a schematic view of an exercise assembly according to an embodiment of the present disclosure. The present disclosure provides a fitness device, which includes an exercise assembly 1. The exercise assembly 1 at least includes a linear motor 11 and a first rotary motor 12. A user can operate the exercise assembly 1 according to various movement trajectories of multiple training movements, such that the exercise assembly 1 is driven by the linear motor 11 to move linearly along an axis, and is driven by the first rotary motor 12 to rotate. It should be noted that the linear motor 11 and the first rotary motor 12 are used to provide resistive forces. When the user operates the exercise assembly 1, the first rotary motor 12 outputs a rotational resistive force in response to the rotation of the exercise assembly 1, the linear motor 11 outputs a linear resistive force in response to the movement of the exercise assembly 1, and the rotational resistive force and the linear resistive force are combined to form an integrated resistive force.

The specific implementation form of the exercise assembly 1 is not limited in the present disclosure. The aforementioned description for the exercise assembly 1 of the first embodiment in FIG. 1 is merely an example, and is not meant to limit the scope of the present disclosure. As long as any assembly including a linear motor and a rotary motor is used to provide the resistive force for the user to exercise, it should be considered an equivalent variation of the exercise assembly 1 of the present disclosure.

Figure 2:
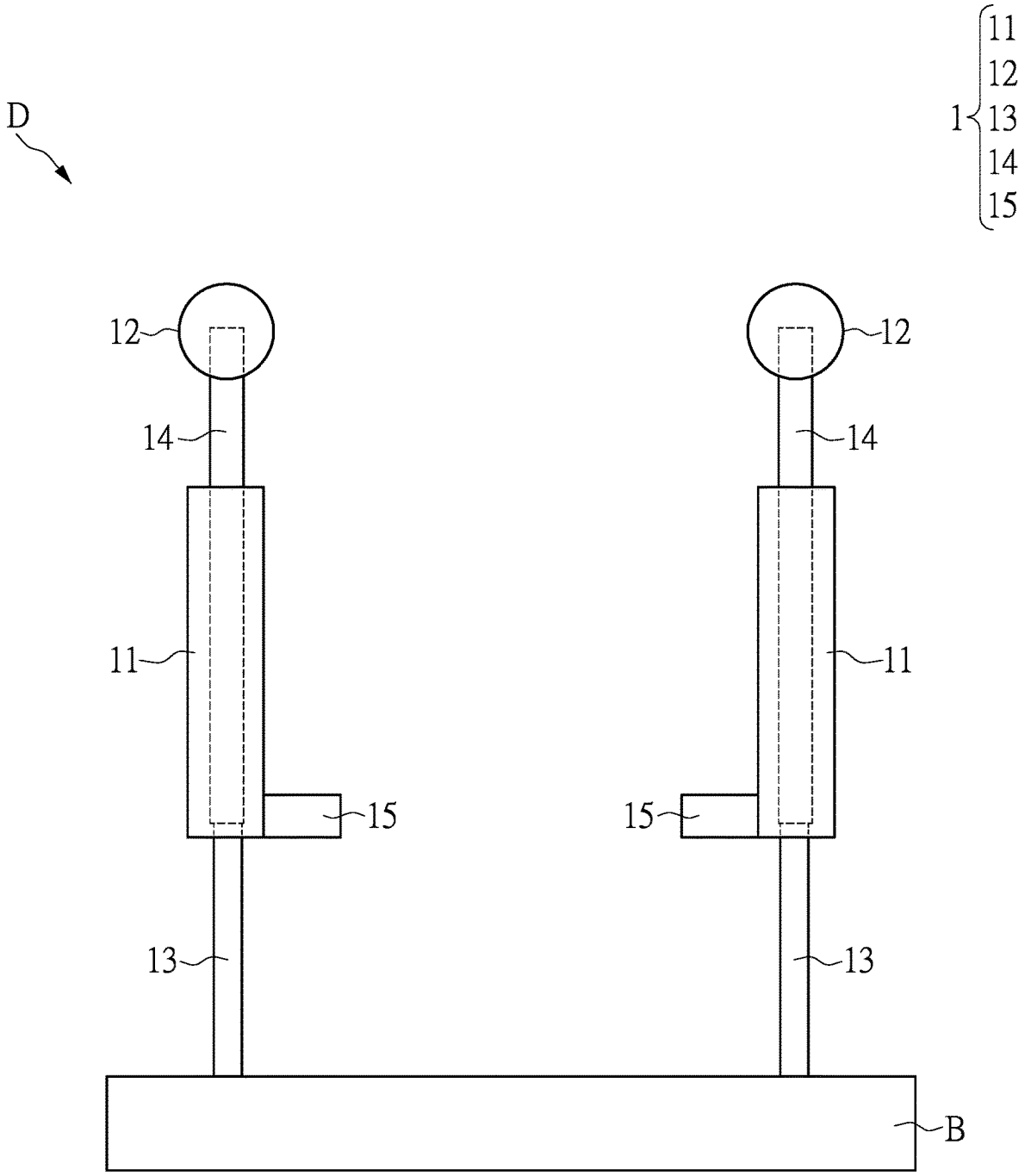
FIG. 2 is a schematic view of a fitness device according to the embodiment of the present disclosure.
Figure 3:
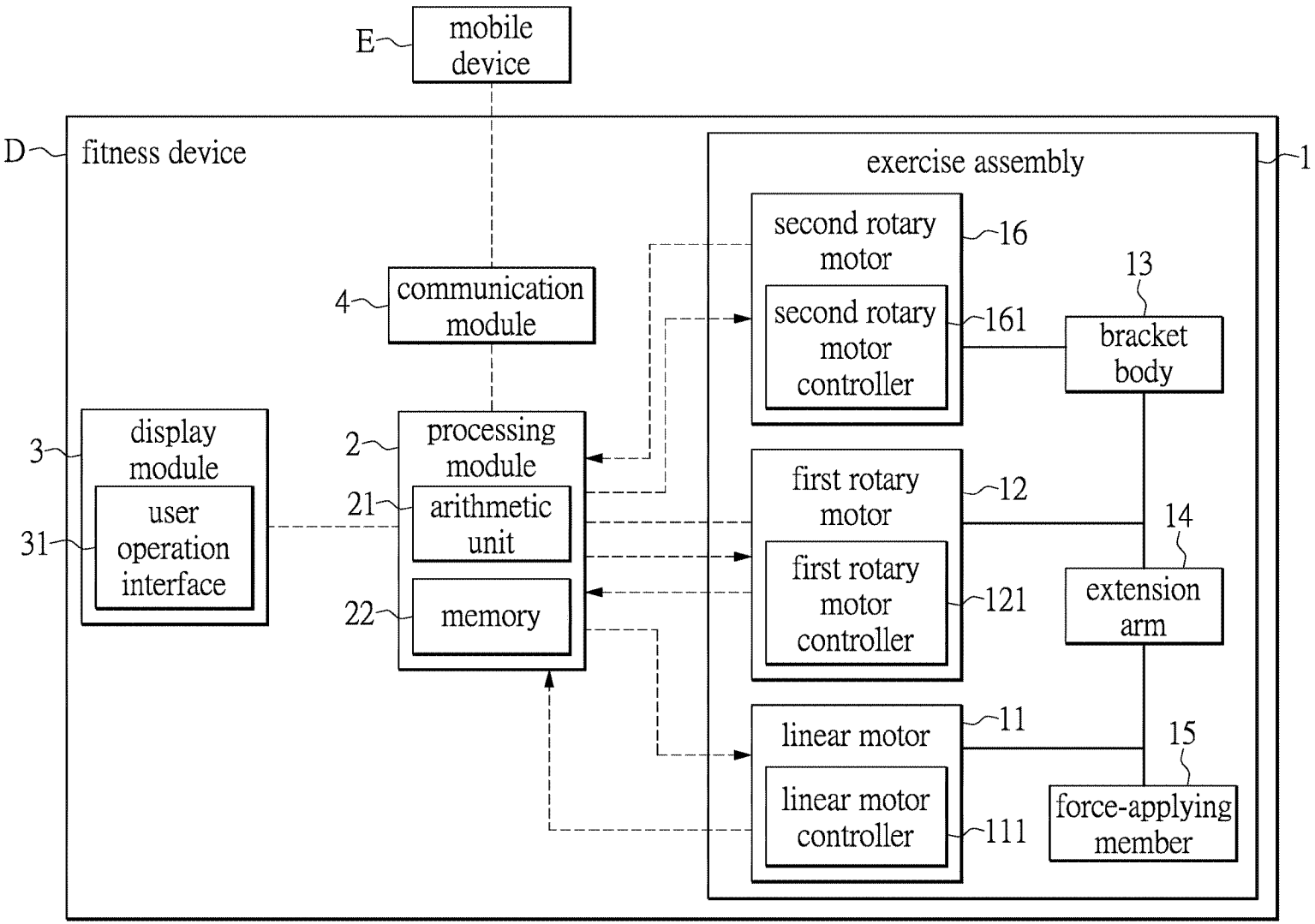
FIG. 3 is a functional block diagram of the fitness device according to the embodiment of the present disclosure.

Referring to FIG. 2 and FIG. 3, FIG. 2 is a schematic view of a fitness device according to the embodiment of the present disclosure, and FIG. 3 is a functional block diagram of the fitness device according to the embodiment of the present disclosure. A quantity of the exercise assembly 1 is not limited in the present disclosure. For example, a fitness device D includes two exercise assemblies 1, and the two exercise assemblies 1 are fixed on a base B and separated from each other by a fixed gap. In addition to the linear motor 11 and the first rotary motor 12, each exercise assembly 1 further includes a bracket body 13, an extension arm 14 and a force-applying member 15.

As shown in FIGS. 1 to 3, the bracket body 13 is fixed on the base B. The first rotary motor 12 is connected between the bracket body 13 and the extension arm 14. The force-applying member 15 is connected to the linear motor 11. The force-applying accessory 15 can be, for example, a handle, a barbell, or a roller for leg support, but the present disclosure is not limited thereto. The user applies an exerted force to the force-applying accessory 15 by his hands or feet to drive the exercise assembly 1. Specifically, the above-mentioned movement trajectories refer to the movement trajectories of the force-applying accessory 15. The extension arm 14 is driven by the first rotary motor 12 to rotate relative to the bracket body 13. The force-applying accessory 15 is driven by the linear motor 11 to move linearly relative to the extension arm 14.

As shown in FIG. 3, the fitness device D provided by the present disclosure further includes a processing module 2 and a display module 3. The display module 3 is electrically connected to the processing module 2. The processing module 2 can be, for example, a microcontroller, which includes an arithmetic unit 21 and a memory 22. The processing module 2 is disposed in the fitness device D and electrically connected to a linear motor controller 111 of the linear motor 11 and a first rotary motor controller 121 of the first rotary motor 12. The display module 3 can be, for example, a fitness mirror that is disposed on the bracket body 13, such that the user can face the display module 3 to check whether his posture is correct during exercise.

In addition, the display module 3 has a user operation interface 31. The specific implementation form of the user operation interface 31 is not limited in the present disclosure. For example, the user operation interface 31 allows the user to select and input the body parts to be trained, the training movements to be performed for the body parts, and the required resistive force to be carried. The user can input a predetermined value of the integrated resistive force through the user operation interface 31, such that the linear motor 11 and the first rotary motor 12 output the linear resistive force and the rotational resistive force correspondingly. Therefore, the user applies an exerted force greater than the integrated resistive force to overcome the resistive force output by the linear motor 11 and the first rotary motor 12 to achieve the training effect.

Figure 4:
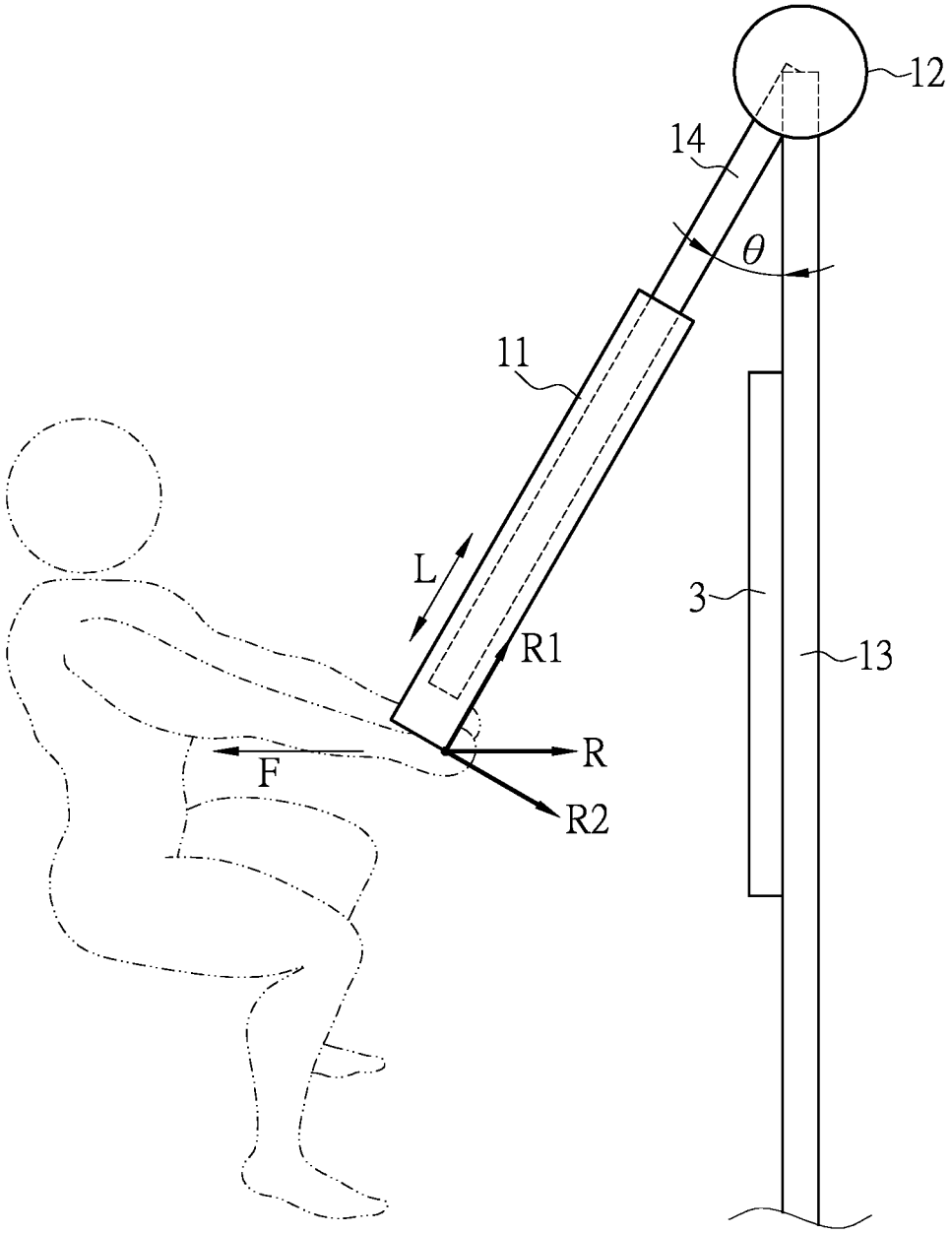
FIG. 4 is a first schematic view of a user operating the fitness device to perform seated rowing according to the embodiment of the present disclosure.
Figure 5:
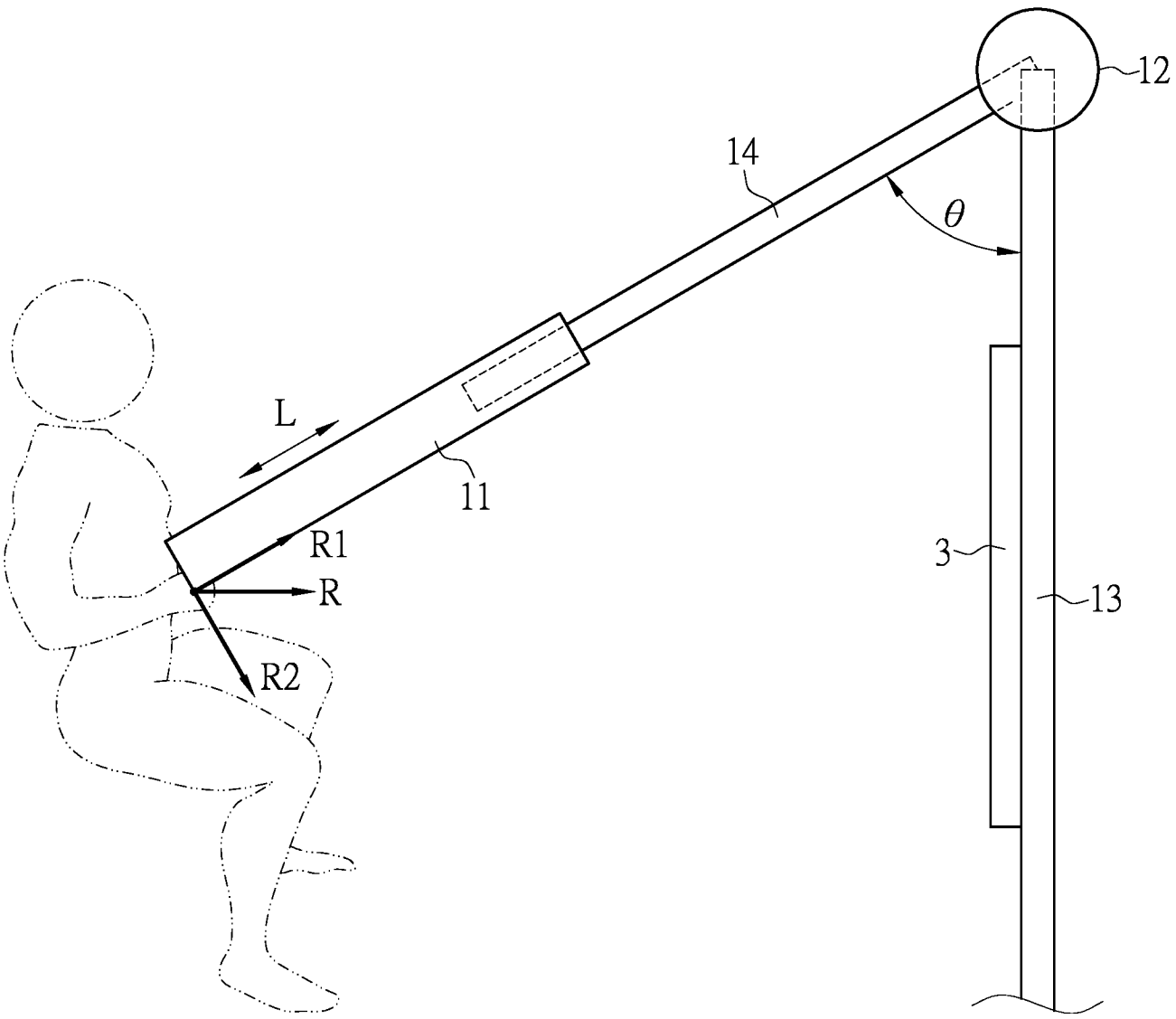
FIG. 5 is a second schematic view of the user operating the fitness device to perform seated rowing according to the embodiment of the present disclosure.

The application of the fitness device according to the embodiment of the present disclosure will be further described. Referring to FIGS. 3 to 5, FIGS. 4 and 5 are schematic views of a user operating the fitness device to perform seated rowing according to the embodiment of the present disclosure. For example, when the user sets an integrated resistive force R through the display module 3 and starts to operate the fitness device D to perform seated rowing, the user holds the handle (i.e., the force-applying member 15) and applies a horizontal force F to pull the exercise assembly 1 close to the user's body. Through the operation of the linear motor 11 and the first rotary motor 12, the force-applying member 15 generates a displacement L and the extension arm 14 rotates by an angle (i.e., a rotation angle $\Theta$). It should be noted that when the user operates the exercise assembly 1, the displacement L and the rotation angle $\Theta$ change depending on the position of the force-applying member 15.

The displacement L is an elongation distance of the exercise assembly 1, and the rotation angle $\Theta$ is a rotation angle of the exercise assembly 1. The movement trajectory is a horizontal straight line. In response to the elongation and rotation of the exercise assembly 1, the linear motor 11 outputs a linear resistive force R1, and the first rotary motor 12 outputs a rotational resistive force R2. The linear resistive force R1 and the rotational resistive force R2 are combined to form the integrated resistive force R, and the linear resistive force R1 and the rotational resistive force R2 conform to the following relationship:

$$R1 = R \times \sin(\Theta);$$

$$R2 = R \times \cos(\Theta).$$

Figure 6:
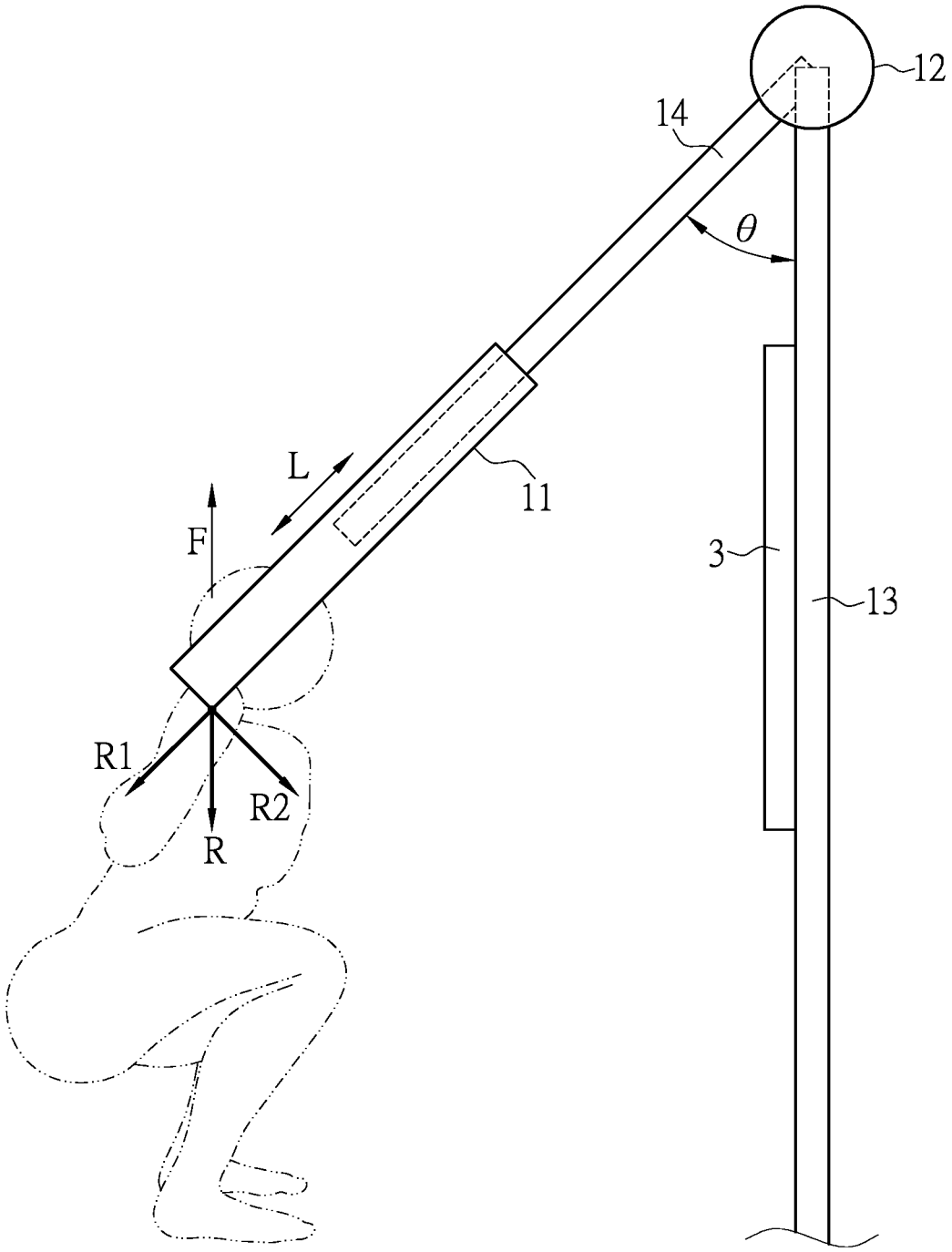
FIG. 6 is a first schematic view of a user operating the fitness device to perform barbell squats according to the embodiment of the present disclosure.
Figure 7:
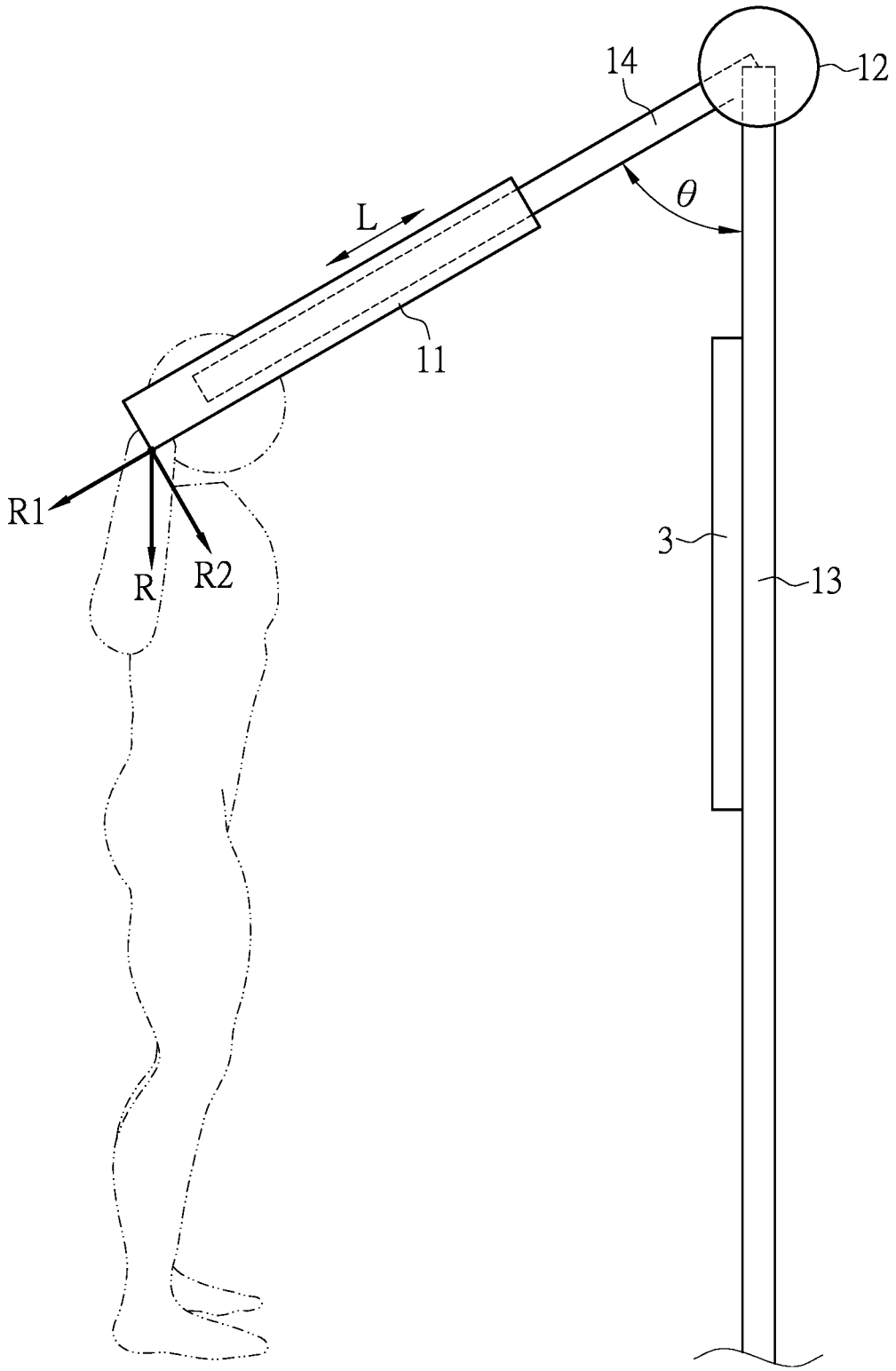
FIG. 7 is a second schematic view of a user operating the fitness device to perform barbell squats according to the embodiment of the present disclosure.

Referring to FIGS. 3, 6, and 7, FIG. 6 and FIG. 7 are schematic views of a user operating the fitness device to perform barbell squats according to the embodiment of the present disclosure. When the user operates the fitness device D to perform barbell squats, the user supports the barbell (i.e., the force-applying member 15) through the muscles between the shoulders and neck to squat down and stand up straight. When the user stands up and applies a vertical force F, the linear motor 11 generates a displacement L and the extension arm 14 rotates by an angle (i.e., a rotation angle $\Theta$). The movement trajectory is a vertical straight line. In response to the elongation and rotation of the exercise assembly 1, the linear motor 11 outputs a linear resistive force R1, and the first rotary motor 12 outputs a rotational resistive force R2. The linear resistive force R1 and the rotational resistive force R2 are combined to form the integrated resistive force R, and the linear resistive force R1 and the rotational resistive force R2 conform to the following relationship:

$$R1 = R \times \cos(\Theta);$$

$$R2 = R \times \sin(\Theta).$$

From the perspective of seated rowing and barbell squatting, when the movement trajectory is a straight line, the resultant resistive force R is parallel to the movement trajectory.

Figure 8:
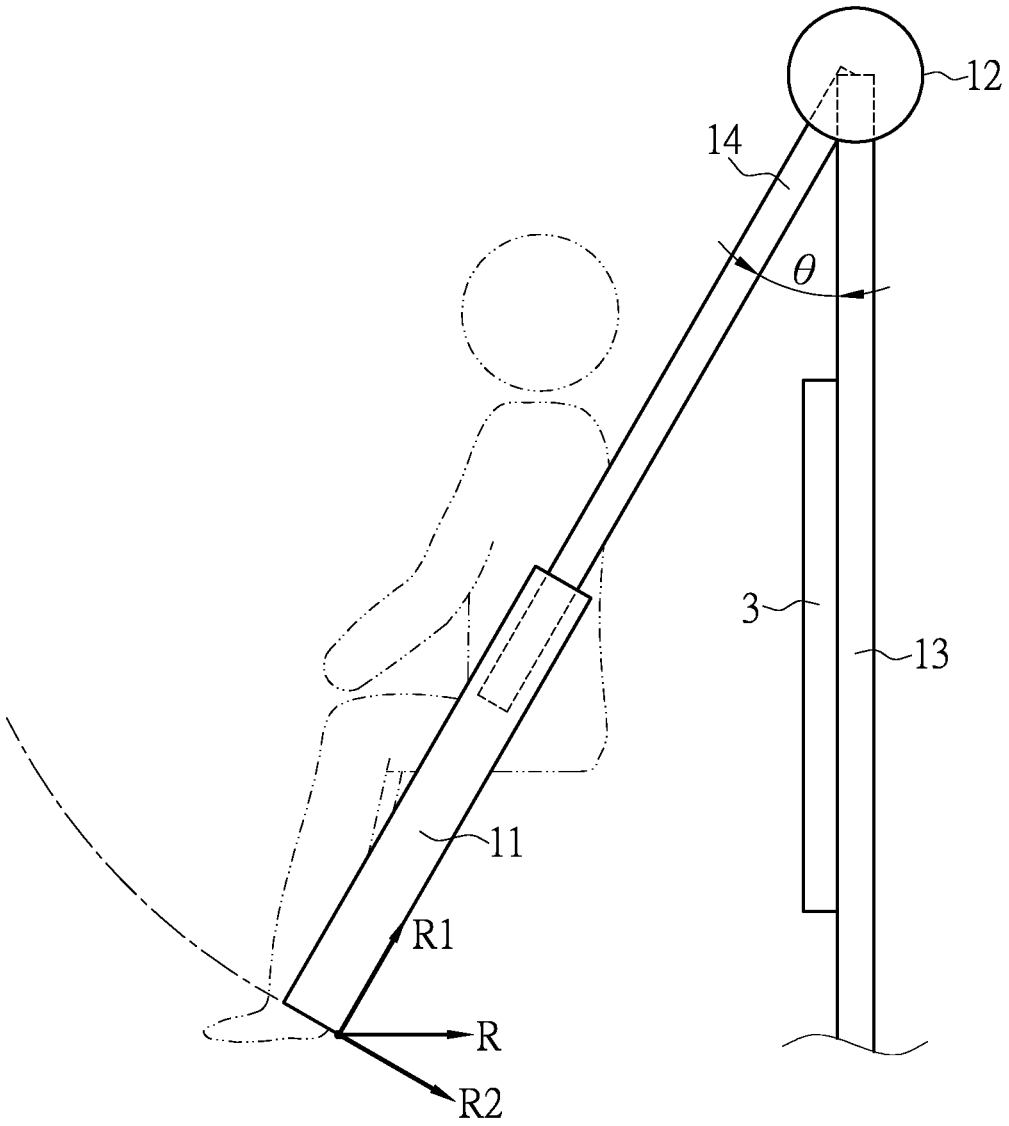
FIG. 8 is a schematic view of a user operating the fitness device to perform seated leg extension according to the embodiment of the present disclosure.

Referring to FIG. 3 and FIG. 8, FIG. 8 is a schematic view of a user operates the fitness device to perform seated leg extension according to the embodiment of the present disclosure. For example, when the user operates the fitness device D to perform seated leg extension, the user leans against the roller with his calf (i.e., the force-applying member 15) for straightening the knee and extending the leg. The movement trajectory is a curved line, and the direction of the exerted force applied by the user is the tangent direction of the movement trajectory. In response to the driving of the exercise assembly 1, the linear motor 11 outputs a linear resistive force R1, and the first rotary motor 12 outputs a rotational resistive force R2. The linear resistive R1 and the rotational resistive force R2 are combined to the integrated resistive force R. The integrated resistive force R is parallel to the tangent direction of the movement trajectory, and the linear resistive force R1 and the rotational resistive force R2 conform to the following relationship that is same as seated rowing:

$$R1 = R \times \sin(\Theta);$$

$$R2 = R \times \cos(\Theta).$$

As shown in FIG. 3, the linear motor 11 includes the linear motor controller 111. The first rotary motor 12 includes the first rotary motor controller 121. The processing module 2 is electrically connected to the first rotary motor controller 121 and the linear motor controller 111. The first rotary motor controller 121 is used to detect the rotation angle ⊖, the linear motor controller 111 is used to detect the displacement L. Furthermore, the processing module 2 includes the arithmetic unit 21 and the memory 22. The first rotary motor controller 121 and the linear motor controller 111 transmit the rotation angle ⊖ and the displacement L to the memory 22 of the processing module 2 for storage.

Figure 10:
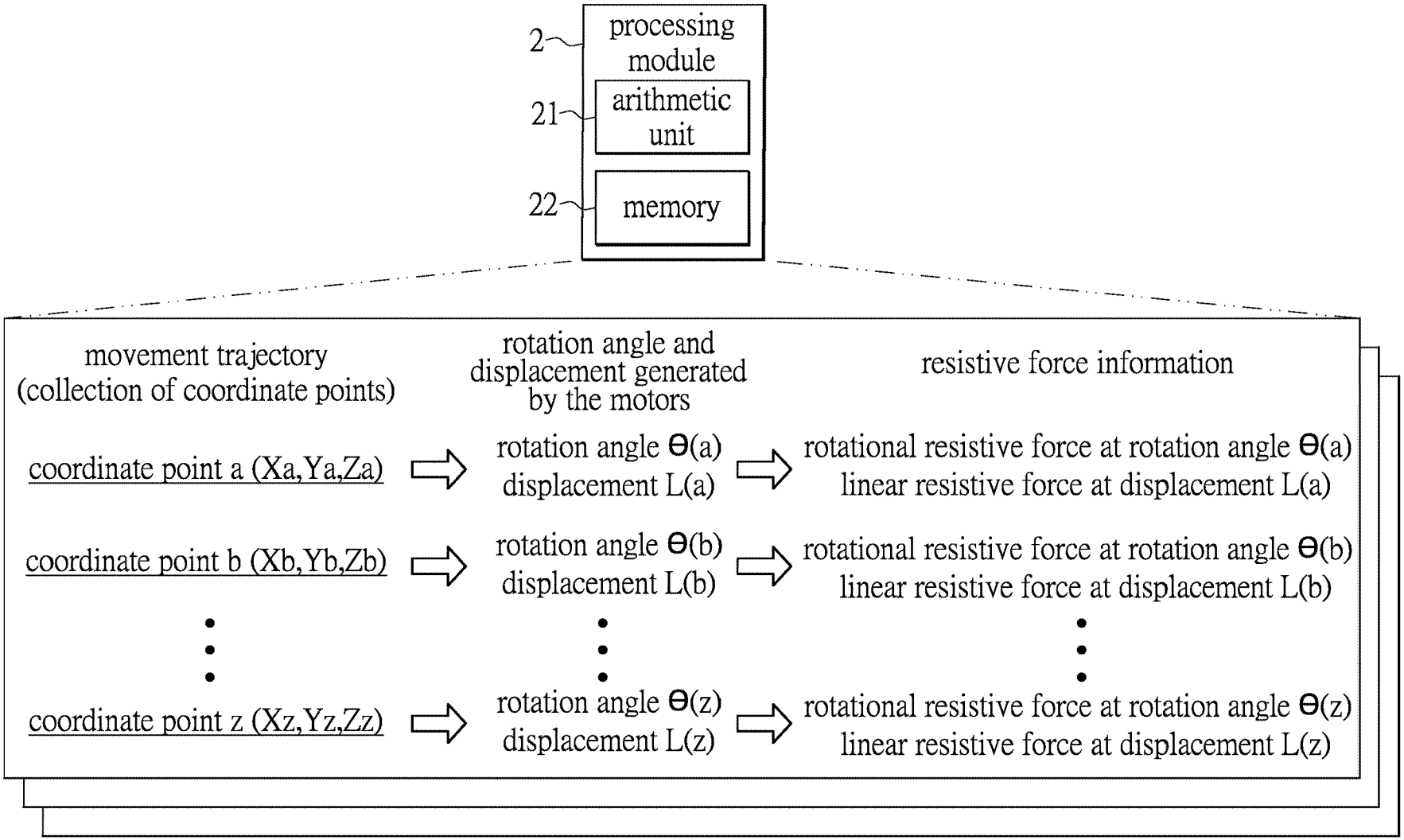
FIG. 10 is a schematic diagram of internal information of a processing module in the fitness device according to the embodiment of the present disclosure.

Referring to FIG. 3 and FIG. 10, FIG. 10 is a schematic view of internal information of a processing module in the fitness device according to the embodiment of the present disclosure. The movement trajectory of each exercise, such as seated rowing, barbell squats, and seated leg extension includes a plurality of coordinate points. Each of the coordinate points has information including the displacement L and the rotation angle ⊖. The memory 22 of the processing module 2 stores the plurality of coordinate points of different movement trajectories and related information of their displacement and rotation angle. The memory 22 of the processing module 2 stores a plurality of coordinate points of different movement trajectories and related information including the displacement and the rotation angle thereof.

For example, as shown in FIG. 10, the movement trajectory includes multiple coordinate points, such as coordinate point a (Xa, Ya, Za), coordinate point b (Xb, Yb, Zb) . . . coordinate point z (Xz, Yz, Zz). The coordinate point a has information including a rotation angle ⊖(a) and a displacement L(a). The displacement L(a) is the elongation distance of the exercise assembly 1 moving to the coordinate point a. The rotation angle ⊖(a) is the rotation angle at which the exercise assembly 1 rotates to the coordinate point a. The coordinate point b has information including a rotation angle ⊖(b) and a displacement L(b). The displacement L(b) is the elongation distance of the exercise assembly 1 moving to the coordinate point b. The rotation angle ⊖(b) is the rotation angle at which the exercise assembly 1 rotates to the coordinate point b. The coordinate point z has information including a rotation angle ⊖(z) and a displacement L(z). The displacement L(z) is the elongation distance of the exercise assembly 1 moving to the coordinate point z. The rotation angle ⊖(z) is the rotation angle at which the exercise assembly 1 rotates to the coordinate point z.

Furthermore, the elongation distances and the rotation angles of the exercise assembly 1 are different at different coordinate points. Because of differences in the elongation distances and the rotation angles, the linear resistive force output by the linear motor 11 at different coordinate points and the rotational resistive force output by the first rotary motor 12 at different coordinate points are also different. In addition, the memory 22 of the processing module 2 further stores the information of the resistive force corresponding to each coordinate point, that is, the linear resistive force output by the linear motor 11 corresponding to the elongation distance, and the rotational resistive force output by the first rotary motor 12 corresponding to the rotation angle.

In order to further illustrate the actuation mechanism of the fitness device D of the present disclosure, the action of seated rowing in FIGS. 4 and 5 will be used as an example below, and reference is further made to FIGS. 2 and 3 together for convenience of explanation. For example, in the beginning, the user can select the action of seated rowing through the user operation interface 31 of the display module 3 and set the integrated resistive force R of 10 kg.

When the user operates the fitness device D to perform seated rowing as shown in FIG. 4, the displacement L can be, for example, 20 cm, and the rotation angle ⊖ can be, for example, 30 degrees. The linear motor controller 111 and the first rotary motor controller 121 feed back the displacement L(i.e., 20 cm) output by the linear motor 11 and the rotation angle ⊖ (i.e., 30 degrees) output by the first rotary motor 12 to the processing module 2, respectively. Based on the displacement L and rotation angle ⊖ detected by the linear motor controller 111 and the first rotary motor controller 121, the arithmetic unit 21 of the processing module 2 can identify the coordinate point corresponding to the user's current action, and output corresponding resistive force information to the linear motor controller 111 and the first rotary motor controller 121. Based on the resistive force information, the linear motor controller 111 controls the linear motor 11 to output a linear resistive force R1 of 5 kg, and the first rotary motor controller 121 controls the first rotary motor 12 to output a rotational resistive force R2 of 8.66 kg, such that the linear resistive force R1 and the rotational resistive force R2 can be combined to an integrated resistive force R of 10 kg.

Then, when the user operates the fitness device D to perform seated rowing as shown in FIG. 5, the displacement L can be, for example, 80 cm, and the rotation angle ⊖ can be, for example, 60 degrees. The linear motor controller 111 and the first rotary motor controller 121 feedback the displacement L output by the linear motor 11 and the rotation angle ⊖ output by the first rotary motor 12 to the processing module 2, respectively. Based on the displacement L(i.e., 80 cm) and rotation angle ⊖ (i.e., 60 degrees) detected by the linear motor controller 111 and the first rotary motor controller 121, the arithmetic unit 21 of the processing module 2 can identify the coordinate point corresponding to the user's current action, and output corresponding resistive force information to the linear motor controller 111 and the first rotary motor controller 121. Based on the resistive force information, the linear motor controller 111 controls the linear motor 11 to output a linear resistive force R1 of 8.66 kg, and the first rotary motor controller 121 controls the first rotary motor 12 to output a rotational resistive force R2 of 5 kg, such that the linear resistive force R1 and the rotational resistive force R2 can be combined to an integrated resistive force R of 10 kg.

It should be noted that when the user operates the exercise assembly 1 with incorrect actions, the displacement and rotation angle detected by the linear motor controller 111 and the first rotary motor controller 121 will be inconsistent with the displacement L and rotation angle ⊖ of the coordinate point for correct actions, such that the arithmetic unit 21 is unable to identify the coordinate point corresponding to the incorrect actions. Therefore, the arithmetic unit 21 will not output corresponding resistive force information to the linear motor controller 111 and the first rotary motor controller 121. In other words, if the user operates the exercise assembly 1 with the wrong actions, the linear motor controller 111 and the first rotary motor controller 121 is unable to output resistive force for the user to train, or in the alternative, when the user's posture is incorrect, and the user does not push and pull according to the correct movement trajectory, the exercise assembly 1 cannot be moved.

Figure 9:
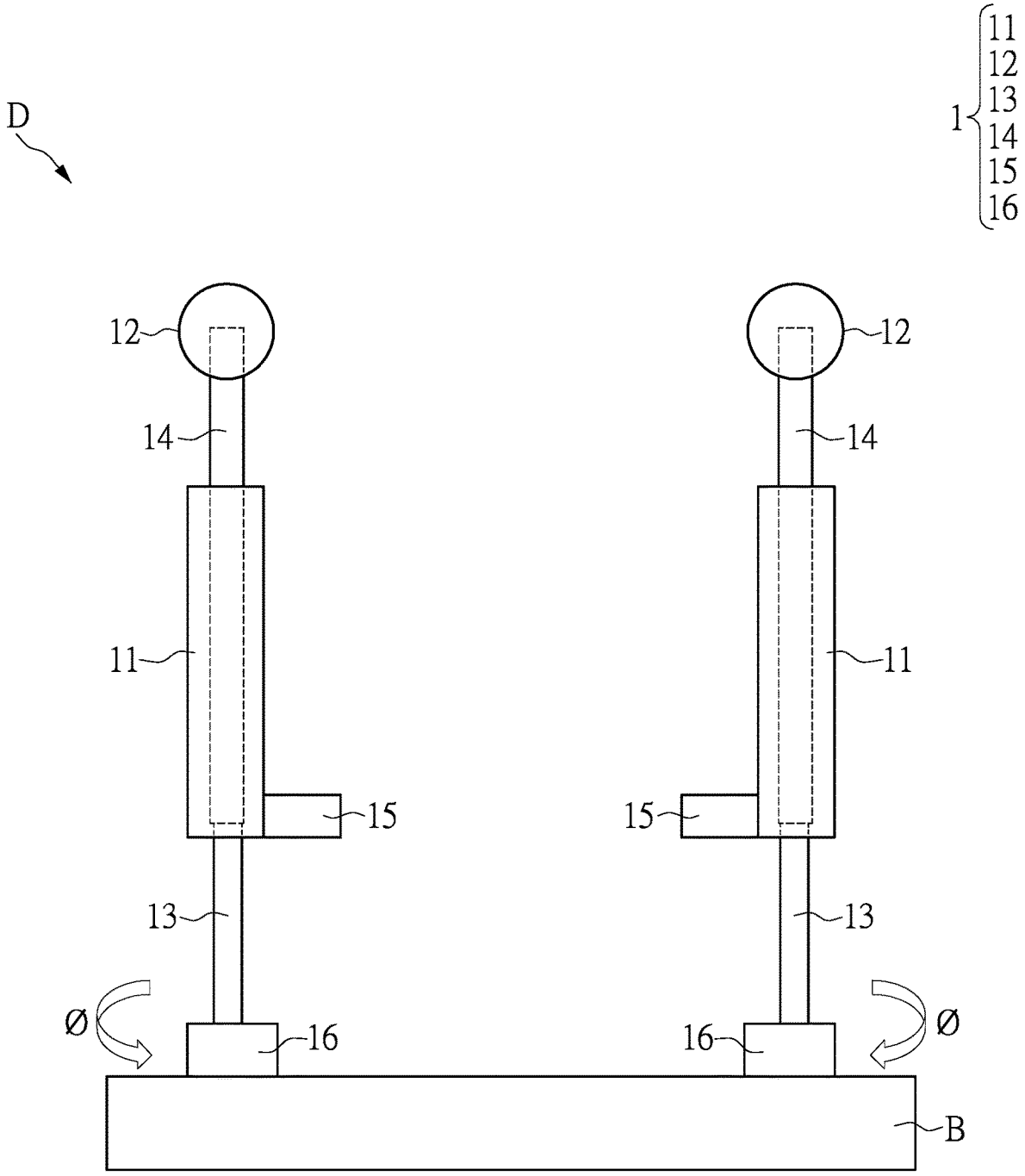
FIG. 9 is a schematic view of a fitness device according to another embodiment of the present disclosure.

Referring to FIG. 3 and FIG. 9, FIG. 9 is a schematic view of a fitness device according to another embodiment of the present disclosure. Comparing FIG. 2 with FIG. 9, the exercise assembly 1 in FIG. 9 further includes a second rotary motor 16, and the second rotary motor 16 is connected between the bracket body 13 and the base B. The bracket body 13 can be driven by the second rotary motor 16 to rotate relative to the base B.

For example, when the user operates the fitness device D shown in FIG. 9 to simulate a butterfly machine to perform chest clamping, the user holds the handle (i.e., the force-applying member 15) and applies an exerted force to the exercise assembly 1, and the exercise assembly 1 rotates by an angle (i.e., a azimuth angle Ø) through the second rotary motor 16. The second rotary motor 16 outputs a second rotational resistive force in response to the rotation of the exercise assembly 1. An extending direction of a rotating shaft of the second rotary motor 16 is different from an extending direction of a rotating shaft of the first rotary motor 12.

Therefore, the coordinate points that are included in the movement trajectory of the chest clamping action include information about the azimuth angle Ø in addition to the displacement L and the rotation angle ⊖. As mentioned above, the azimuth angle Ø is the rotation angle at which the exercise assembly 1 rotates by the second rotary motor 16. The second rotary motor 16 includes a second rotary motor controller 161 electrically connected to the processing module 2. The second rotary motor 16 includes a second rotary motor controller 161 that is electrically connected to the processing module 2. The second rotary motor controller 161 is used to detect the azimuth angle Ø, and transmit the detected azimuth angle Ø to the processing module 2 for storage. Furthermore, in addition to the linear resistive force output by the linear motor 11 corresponding to the displacement L and the rotational resistive force output by the first rotary motor 12 corresponding to the rotation angle ⊖, the resistive force information stored in the memory 22 of the processing module 2 further includes the second rotational resistive force output by the second rotary motor 16 corresponding to the azimuth angle Ø.

Therefore, based on the displacement L, the rotation angle ⊖, and the azimuth angle Ø detected by the linear motor controller 111, the first rotary motor controller 121, and the second rotary motor controller 161, the arithmetic unit 21 of the processing module 2 can identify the coordinate point of the user's current action and output the corresponding resistive force information to the linear motor controller 111, the first rotary motor controller 121, and the second rotary motor controller 161. Then, the linear motor controller 111, the first rotary motor controller 121, and the second rotary motor controller 161 control the resistive force output by the linear motor 11, the first rotary motor 12, and the second rotary motor 16 based on the resistive force information.

As shown in FIG. 3, the fitness device D further includes a communication module 4 that is electrically connected to the processing module 2. The communication module 4 is used for network connection with the user's mobile device E such as a mobile device E. The user can input instructions to the processing module 2 through a built-in application of the mobile device E, so as to select the training movements to be performed such as seated rowing, barbell squatting, seated leg extension, and chest clamping, and set the required integrated resistive force.

In conclusion, in the fitness device D provided by the present disclosure, various movements such as curls, dead lifts, leg presses, and bench presses can be simulated through the combination of the linear motor 11 and the rotary motor (i.e., the first rotary motor 12 and the second rotary motor 16), such as to train different body parts of the user. Furthermore, in the fitness device D provided by the present disclosure, the resistive forces in the horizontal direction or the vertical direction for requirements can be adjusted, so that the user can apply forces in the horizontal direction (e.g., push and pull) and the vertical direction (e.g., lift and press) to perform targeted exercises of specific muscle groups with correct exercise postures to achieve good exercise efficiency and effect.

Since the fitness device D of the present disclosure only outputs the resistive force through the motor to allow the user to exercise, the resistive force is generated by the motor only when the user operates the exercise assembly 1. In other words, when the user has insufficient strength during exercise and releases the exercise assembly 1, the resistive force of the motor will stop being output. Thereby, the user does not need to worry about letting go of the exercise assembly 1 and causing the body to bear extra load and causing injuries.

In addition, the user can select and input the body parts to be trained, the training movements to be performed for the body parts, and the required resistive force to be carried through the user operation interface 31 of the display module 3. When the user is a beginner, the output value of the integrated resistive force can be set to 0 and the fitness device D can enter a coaching mode. In the coaching mode, the user operates the exercise assembly 1 without the resistive forces output by the linear motor 11 and the rotary motor (the first rotary motor 12 and the second rotary motor 16), so that the user can be familiar with the training posture to be operated. After being familiar with the movements, the appropriate integrated resistive forces can be gradually set for exercise.

Therefore, the fitness device D of the present disclosure can avoid injuries caused by inappropriate training postures, exertion, and accidents, thereby allowing the user to exercise in a safe and stable state, and improving the motivation for and safety of the fitness exercise.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A fitness device, comprising:

an exercise assembly including a first rotary motor and a linear motor, wherein a user can apply an exerted force to operate the exercise assembly according to various movement trajectories of multiple training movements, such that the exercise assembly is driven by the linear motor to move linearly along an axis, and is driven by the first rotary motor to rotate;

wherein the first rotary motor outputs a rotational resistive force in response to the rotation of the exercise assembly, the linear motor outputs a linear resistive force in response to the movement of the exercise assembly, the rotational resistive force and the linear resistive force are combined to form an integrated resistive force, and the exerted force is greater than the integrated resistive force when the user operates the assembly.

2. The fitness device according to claim 1, wherein, when one of the movement trajectories is a straight line, the integrated resistive force is parallel to the straight line; wherein, when one of the movement trajectories is a curved line, the integrated resistive force is parallel to a tangent direction of the curved line.

3. The fitness device according to claim 1, wherein each of the movement trajectories includes a plurality of coordinate points, each of the coordinate points includes a displacement and a rotation angle, the displacement is an elongation distance of the exercise assembly moving to each of the coordinate points, and the rotation angle is an angle at which the exercise assembly rotates to each of the coordinate points.

4. The fitness device according to claim 3, further comprising a processing module, wherein the linear motor includes a linear motor controller, the first rotary motor includes a first rotary motor controller, and the processing module is electrically connected to the first rotary motor controller and the linear motor controller; wherein the first rotary motor controller is used to detect the rotation angle, the linear motor controller is used to detect the displacement, and the first rotary motor controller and the linear motor controller transmit the rotation angle and the displacement to the processing module for storage.

5. The fitness device according to claim 4, wherein the processing module further stores the coordinate points of the movement trajectories and resistive force information corresponding to each of the coordinate points, the resistive force information includes the linear resistive force output by the linear motor corresponding to the displacement and the rotational resistive force output by the first rotary motor corresponding to the rotation angle.

6. The fitness device according to claim 5, wherein, when the user selects one of the training movements, based on the displacement and the rotation angle detected by the linear motor controller and the first rotary motor controller, the processing module identifies the coordinate point corresponding to the user's current action, and the processing module outputs corresponding resistive force information to the linear motor controller and the first rotary motor controller to respectively control the linear motor and the first rotary motor to output corresponding linear resistive force and corresponding rotational resistive force.

7. The fitness device according to claim 4, wherein the exercise assembly further includes a second rotary motor, the can apply the exerted force to operate the exercise assembly, such that the exercise assembly is driven by the second rotary motor to rotate, and the second rotary motor outputs a second rotational resistive force in response to the rotation of the exercise assembly; wherein an extending direction of a rotating shaft of the second rotary motor is different from an extending direction of a rotating shaft of the first rotary motor.

8. The fitness device according to claim 7, wherein each of the coordinate points further includes an azimuth angle, and the azimuth angle is an angle at which the exercise assembly rotates by the second rotary motor; wherein the second rotary motor includes a second rotary motor controller that is electrically connected to the processing module, and the second rotary motor controller is used to detect and transmit the azimuth angle to the processing module for storage; wherein the resistive force information stored in the processing module further includes the second rotational resistive force output by the second rotary motor corresponding to the azimuth angle.

9. The fitness device according to claim 4, further comprising a display module that is electrically connected to the processing module, wherein the display module is used to display a user operation interface, and the user selects one of the training movements to be performed and sets the required integrated resistive force through the user operation interface.

10. The fitness device according to claim 4, further comprising a communication module that is electrically connected to the processing module, wherein the communication module is used for network connection with a mobile device, and the user can operate a built-in application in the mobile device to select one of the training movements to be performed and sets the required integrated resistive force.

* * * * *